US005295587A

United States Patent [19]

Downes et al.

[11] Patent Number: 5,295,587

[45] Date of Patent: Mar. 22, 1994

[54] EARRING AND BROOCH ORGANIZER

[76] Inventors: Glenn W. Downes; Peggy W. Downes, both of 507 S. 46th St., Baltimore, Md. 21224

[21] Appl. No.: 3,443

[22] Filed: Jan. 8, 1993

[51] Int. Cl.[5] ..... A47F 7/00

[52] U.S. Cl. ..... 211/13; 206/495; 206/566; 206/6.1; 211/118

[58] Field of Search ..... 211/13, 113, 118; 206/6.1, 495, 566

[56] References Cited

U.S. PATENT DOCUMENTS

| | | | |
|---|---|---|---|
| 4,401,219 | 8/1983 | Mink | 206/566 |
| 4,760,920 | 8/1988 | Thomsen | 206/495 |
| 4,821,883 | 4/1989 | Miller | 206/495 |
| 4,958,727 | 9/1990 | Bergeron | 206/495 X |
| 5,025,918 | 6/1991 | Bergeron | 206/495 X |
| 5,121,833 | 6/1992 | Lindsay et al. | 206/6.1 |
| 5,141,113 | 8/1992 | Elliott | 211/13 |

*Primary Examiner*—Robert W. Gibson, Jr.
*Attorney, Agent, or Firm*—Walter G. Finch

[57] ABSTRACT

Herein described is a device for organizing earrings and brooches. The device differs from conventional jewelry boxes in that it provides a greater surface area over which to spread the stored jewelry items. The device comprises a strip of fabric folded to form a front layer and a rear layer, at least one strip of eyelet lace joined to the fabric, and means for suspending the organizing device onto another object. The stems of earrings pierce either the front layer or rear layer of fabric, and the backs are attached in between the layers. In the event that the backs of the earrings fall, a closed bottom fold between the layers of fabric catches the backs and thereby prevents them from being lost. Earrings with clips or wire hoops are readily attached to the strip or strips of eyelet lace. In the preferred embodiment, a vinyl hanger serves as the means for suspending the device onto another object.

5 Claims, 2 Drawing Sheets

EARRING AND BROOCH ORGANIZER

BACKGROUND OF INVENTION

This invention relates to improvements in apparatus used to organize earrings and brooches when they are not being worn, and more particularly, to improvements in an earring and brooch storage device which is economical to manufacture, easy to use, and readily movable from one location to another.

BEST KNOWN PRIOR ART

The best known prior U. S. art is as follows:

U.S. Pat. No. 4,037,272

U.S. Pat. No. 4,710,979

U.S. Pat. No. 5,107,545

The most common device used to store jewelry has in the past been the standard jewelry box. While different types of jewelry boxes have unique characteristics, virtually all become clustered and disorganized to the point where easy access and identification of the earrings and brooches stored therein becomes impossible. Having the jewelry confined to a relatively narrow area, as in a jewelry box, often results in the intertwining of and damage to the stored contents. Consequently, the need exists for an improved earring and brooch organizing device wherein the stored articles are spread-out over a larger area.

In the prior art, numerous cloth devices such as aprons or bibs have provided means to store different items. The Shani U.S. Pat. No. 4,037,272 teaches an apron for the purpose of providing a convenient place to store recipes. In this invention, recipe sheets are attached to metal rings joined to the apron and may therefore be referenced by the wearer of the apron.

The U.S. Pat. No. 4,710,979 issued to Bull et al. describes an apron or bib which is covered with detachable, multi-colored, two dimensional cut-out toys and which allows the caretaker of a child to actively participate in the child's play. The toys are attached to the apron by means of Velcro fastening strips and buttons. The Potter U.S. Pat. No. 5,107,545 teaches an apron for use by a fisherman which assists in fly tying. This apron has an assortment of retaining devices used for storage of tools and other items attached to its upper section by means of stitches or rivets.

What the art lacks, however, is a cloth device similar to those previously described whose specific design and construction allows earrings and brooches to be easily stored and retrieved.

OBJECTS OF THE INVENTION

It is therefore the primary object of this invention to provide a device for organizing earrings and brooches which is simple in construction and easy to use.

It is a further object of this invention to provide a novel earring and brooch organizing device wherein an earring stem may piece either of two layers of cotton cloth or other similar material.

It is still a further object of this invention to provide a unique earring and brooch organizing device which will prevent the loss of earring backings by having the two layers of cloth material open on both sides but closed on the bottom.

Still another object of this invention is to provide an earring and brooch organizing device in which earrings with clips or wire hoops may be readily be attached to strips of eyelet lace stitched to device itself.

To provide a unique earring and brooch organizing device which is easily hung by means of a vinyl hanger, is still another object of this invention.

And to provide a novel earring and brooch organizing device which allows for the easy storage and retrieval of jewelry by spreading out the stored items over a relatively large area is yet another object of this invention.

BRIEF DESCRIPTION OF THE DRAWINGS

These and other objects and attendant advantages of this invention will become more obvious and apparent from the following detailed specification and accompanying drawings in which.

DESCRIPTION OF THE PREFERRED EMBODIMENTS OF INVENTION

Figure 1:
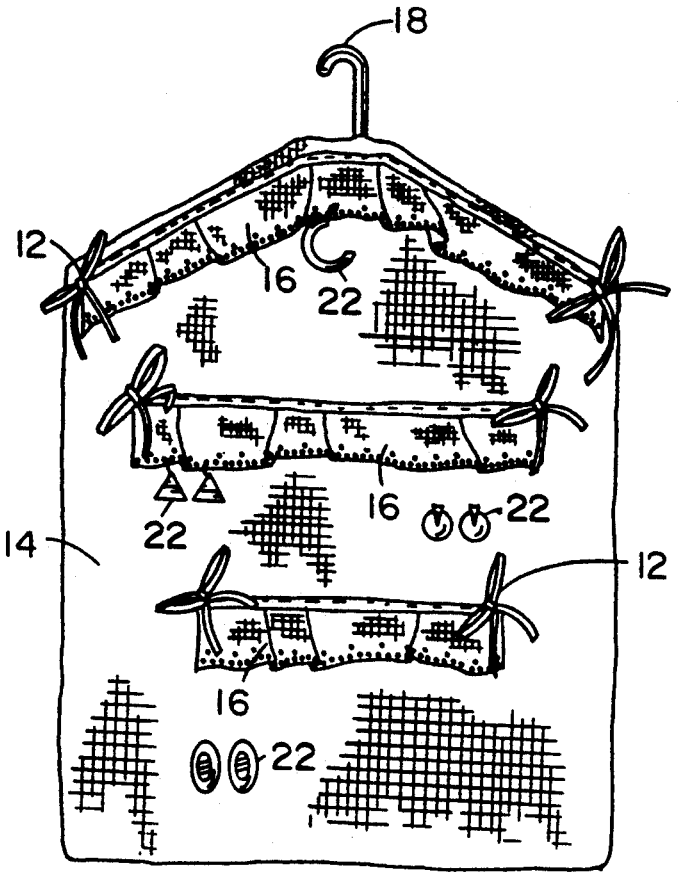
FIG. 1 is a front view of a device for organizing earrings and brooches and incorporating novel features of this invention.

Referring now to FIGS. 1 to 4 of the drawings, there is shown the preferred embodiment of a device for organizing earrings and brooches. The device of FIG. 1 comprises a front layer of fabric 14, strips of eyelet lace 16 stitched to the front layer of fabric 14, a number of decorative bows 12, and a vinyl hanger 18 attached to the top portion of the fabric 14. Earrings and brooches 22 have been attached to both the fabric 14 and eyelet lace 16 in pairs.

Figure 2:
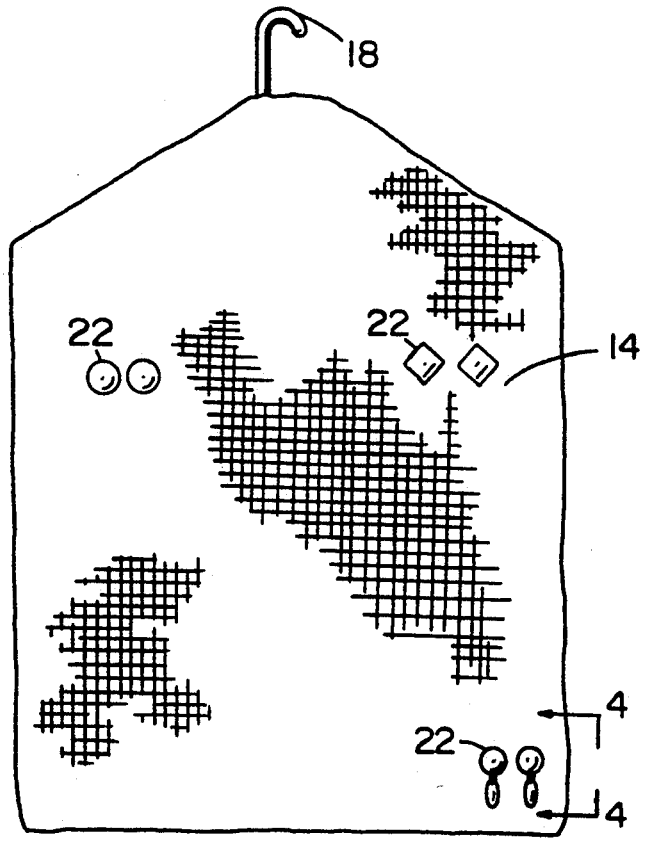
FIG. 2 is a rear view of the device for organizing earrings and brooches of FIG. 1.
Figure 3:
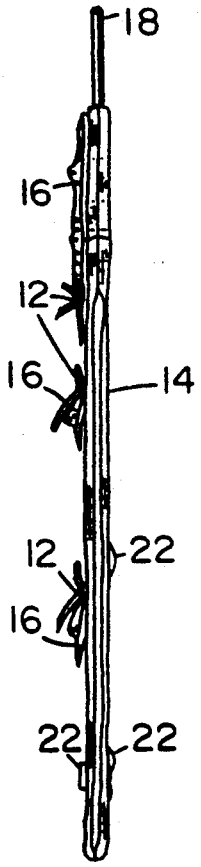
FIG. 3 is a right side view of the device for organizing earrings and brooches of FIG. 1, showing the two layers of cloth material open on their sides but joined on their bottoms.

The device has a simple design consisting of two layers of a single strip of fabric material 14. The strip of fabric 14 is simply folded along one side. This crease forms the closed bottom of the organizing device. FIG. 2 illustrates the face of the rear layer of fabric 14. FIG. 3 shows the sides of both the front and rear layers of fabric 14, as well as the crease formed on the very bottom of the device where the two layers of fabric 14 are folded. The right and left sides of the fabric 14 remain open.

The front and rear layers of fabric 14 come together at the top of the device and encompass a vinyl hanger 18. The hanger 18 may or may not be stitched directly to the fabric 14. The hanger 18, however, supports the earring and brooch device when in use. The front of the device, as seen in FIG. 1, has a number of eyelet lace strips 16 stitched to the front layer of fabric 14. While FIG. 2 shows no eyelet lace strips 16 stitched to the rear layer of fabric 14, such strips 16 may in fact be attached thereto. Additionally, attachment of the eyelet lace strips 16 to the fabric 14 is not limited to the specific pattern shown on FIG. 1.

Figure 4:
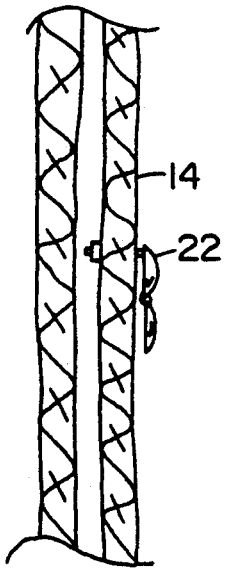
FIG. 4 is an enlarged section view of the side of the earring and brooch organizing device of FIG. 1, illustrating the attachment of an earring to the device.

FIG. 4 illustrates the device in use. Either the front layer or rear layer of fabric 14 is pierced by the stem of an earring 22. After the stem of the earring 22 has pierced the layer of fabric 14, the back of the earring is attached to the stem of the earring 22.

In the manner, the front of the earring 22 is openly exposed on the outer layer of fabric 14, while the back of the earring 22 rests in between the two layers of fabric 14. If the back of the earring 22 should come off of the stem and fall during placement, storage, or retrieval, the closed fold between the two layers of fabric 14 at the bottom of the device will catch the back of the earring 22 and prevent it from being lost. By repeating this procedure, numerous pairs of earrings may be attached at random places all over the front and rear layers of fabric 14.

In the same manner that the layers of fabric 14 hold the pierced earrings 22, the attached strips of eyelet lace 16 hold both clip-on earrings 22 and earrings with wire hoops 22. Standard eyelet lace 16 contains numerous apertures along its length. By placing either the wire hoops or the clips of earrings 22 and other types of brooches 22 through the apertures located on the eyelet strips 16, quick and organized storage of jewelry 22 may be achieved. The decorative bows 12 are purely ornamental.

The earring and brooch organizing device offers a large amount of easily accessible area on both its front and rear faces for the storage of jewelry 22. By having the stored earrings and brooches 22 spread-out over a larger area than is traditionally allowed, the device marks an improvement in the storage and retrieval of jewelry 22. The attached vinyl hanger 18 allows the device to be suspended in a closet, on a door, or wherever is the most convenient.

It should be clear that the invention is not limited to the details illustrated in the accompanying drawings, but may be subject to modifications falling within the spirit and scope of the invention. Therefore, without restricting the invention to the specific construction previously described, the invention shall cover all modifications falling within the scope of the appended claims.

What is claimed is:

1. A device for organizing earrings and brooches, comprising, a strip of fabric folded to form a front layer and a rear layer, at least one strip of eyelet lace joined to said fabric, and means for suspending said device on to another object, wherein said fabric is folded and formed in such a manner to result in two over-lapping layers with open left and right sides and a closed bottom, and whereby said strip of eyelet lace is stitched to the outer face of either of said two layers of said fabric.

2. The device for organizing earrings and brooches as recited in claim 1, whereby the stem of an earring or brooch may readily pierce said fabric and become suspended by said fabric.

3. The device for organizing earrings and brooches as recited in claim 1, wherein said strip of eyelet lace has numerous apertures along its length, and whereby the wire hoops or the clips of earrings and brooches may pass through said apertures and become suspended by said strip of eyelet lace.

4. The device for organizing earrings and brooches as recited in claim 1, whereby said means for suspending said device onto another object is a vinyl hanger.

5. The device for organizing earrings and brooches as recited in claim 1, whereby said strip of fabric is cotton or any other suitable material.

* * * * *